US006488147B2

(12) United States Patent
Mattesky

(10) Patent No.: US 6,488,147 B2
(45) **Date of Patent: *Dec. 3, 2002**

(54) MERCHANDISING SYSTEM

(75) Inventor: Henry Mattesky, Roseland, NJ (US)

(73) Assignee: Magla World Wide, Ltd., Vega Baja, PR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/318,013

(22) Filed: May 25, 1999

(65) Prior Publication Data

US 2002/0017470 A1 Feb. 14, 2002

(51) Int. Cl.[7] ..... B65D 73/00; B65D 85/18

(52) U.S. Cl. ..... 206/278; 206/806; 206/281; 40/663; 40/664

(58) Field of Search ..... D6/315, 160, 159; 223/85; 206/278, 279, 292, 289, 294, 281, 296, 806, 483; 36/1; 40/663, 664

(56) References Cited

U.S. PATENT DOCUMENTS 2,682,122 A * 6/1954 Hanson ..... 229/278
2,995,845 A * 8/1961 Fraser ..... 206/278
3,037,621 A * 6/1962 Jackman ..... 206/294
3,065,946 A * 11/1962 Berkow ..... 206/278
4,485,917 A * 12/1984 Smith ..... 206/278
4,542,827 A * 9/1985 Pilzer ..... 206/483
4,601,417 A * 7/1986 Kunreuther ..... 206/296 X
4,624,060 A * 11/1986 Maxwell ..... 36/1
5,193,676 A * 3/1993 Gold ..... 206/292 X
5,261,580 A * 11/1993 Smith ..... 223/85
5,553,706 A * 9/1996 Gold ..... 206/296
5,864,885 A * 2/1999 Grinberg ..... 2/160
5,950,240 A * 9/1999 Carpenter et al. ..... 2/160
5,988,373 A * 11/1999 Yates ..... 206/292 X
6,010,044 A * 1/2000 Hsiao ..... 223/85

* cited by examiner

*Primary Examiner*—Lee Young
*Assistant Examiner*—Tri M. Mai
(74) *Attorney, Agent, or Firm*—Selitto, Behr & Kim

(57) ABSTRACT

A merchandising system can display merchandise on a display rack. The system has a pair of articles to be worn by a person (for example, gloves). The articles have a right main body and a left main body, each with a user (or hand) opening. The pair of articles have an attachment subsystem for providing an outlying attachment locus for the articles. The attachment subsystem includes a right extremity and a left extremity secured at the user opening of the right main body and the left main body, respectively. The right and the left extremity are each able to reach out of the user opening. The attachment subsystem also includes a display arrangement including a panel. The attachment subsystem is arranged to detachably secure the articles together with the panel, and the right extremity and the left extremity. The attachment subsystem is adapted to hang on the display rack and support the articles. Thus the articles can be attached to and detached from the attachment subsystem without marring either the right main body or the left main body of the articles.

23 Claims, 3 Drawing Sheets

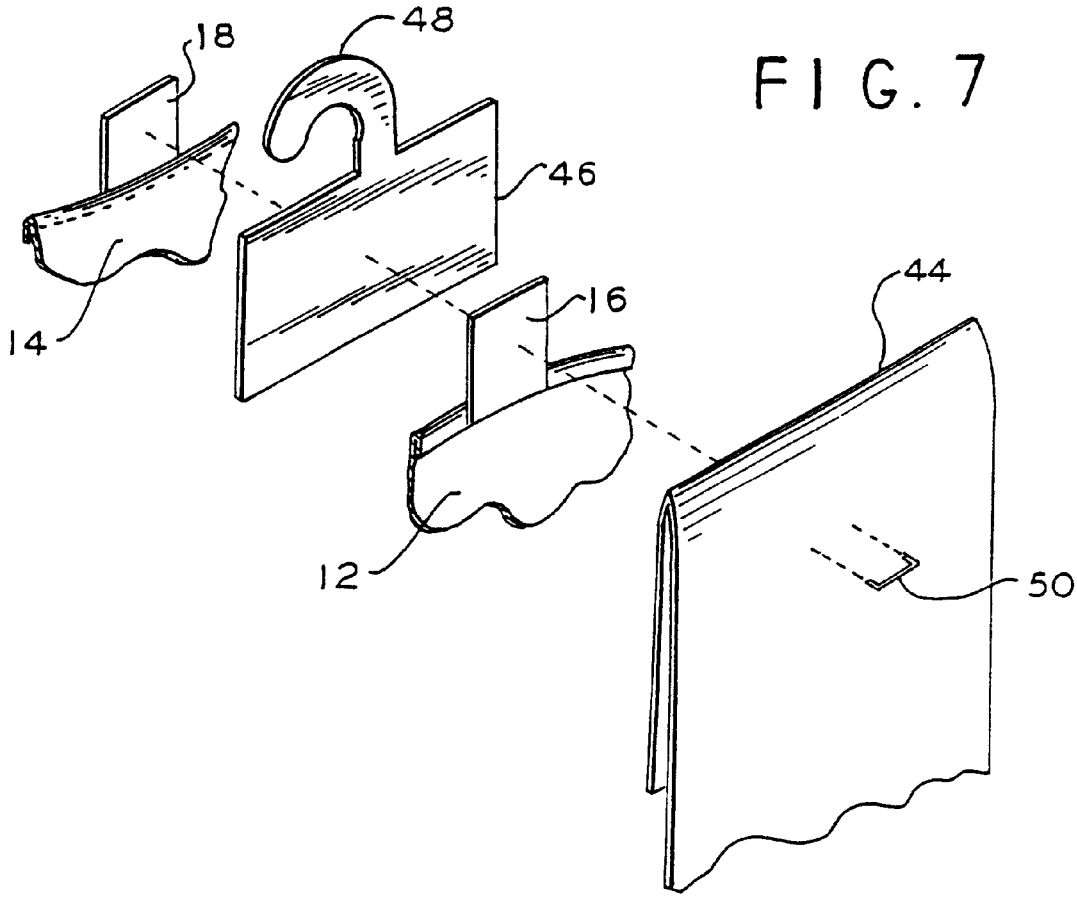
FIG. 7
FIG. 6
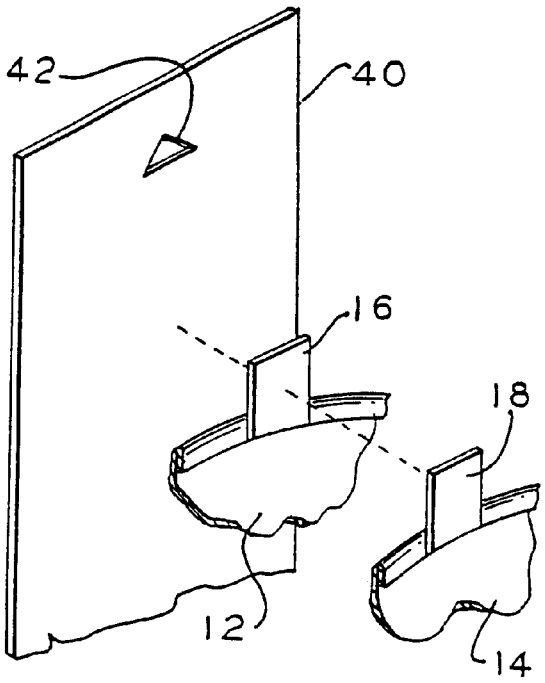
FIG. 9
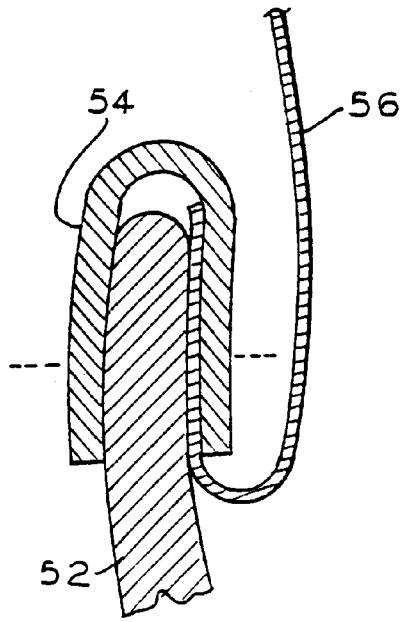

MERCHANDISING SYSTEM

BACKGROUND OF THE INVENTION

1. Field of the Invention

The present invention relates to merchandising systems, and in particular, to systems for hanging a pair of articles on a display rack.

2. Description of Related Art

Merchandise, such as articles that are worn by people, are commonly offered for sale on a display rack. Such a rack may have a number of pegs on which merchandise is hung. A common display technique is to attach merchandise to a display card and then hang the card on a peg in the display rack. The display card may have a hole or a hook-shaped extension for this purpose.

Often the merchandise is attached to this display card by a staple.

Stapling the merchandise, however, punches holes in the goods and can otherwise mars the goods unacceptably. When the merchandise are high-quality gloves made of leather or other costly materials, consumers object to such holes or marring. An example of stapling a display panel to a pair of gloves is shown in U.S. Pat. No. 2,995,845.

U.S. Pat. No. 5,261,580 and 5,503,269 show jaw-like clips for holding gloves on a display rack. These clips, however, are relatively complex and expensive for a disposable item that is only used for display purposes. U.S. Pat. No. 5,193,676 and 5,553,706 show a pair of gloves lashed to a display card. These gloves are made with holes fitted with grommets that are positioned along the edge of the hand opening. However, these gloves are defaced by the holes and grommets.

In U.S. Pat. No. 4,624,060 a fastening filament is looped through the holes in an informational tag, and a pair of the tabs that are secured inside a pair of shoes. This arrangement is designed to keep the shoes together prior to sale. Also, the tabs make punching holes in the shoe uppers unnecessary. These tabs are, however, hidden inside the shoe and do not reach outside thereof. Accordingly, these tabs have a different purpose and are not easily and practically used with a display rack. See also U.S. Pat. No. 1,300,998.

U.S. Pat. No. 2,710,409 shows one glove with a snap fastener, and a mating glove with a leash having a number of snap fasteners. The leash can connect between the gloves to allow the gloves to separate by no more than the length of the leash. Additionally, the gloves can be directly snapped together to form the leash into a loop. This reference has a different purpose and therefore has no disclosure of how a display panel can be attached to the gloves.

In U.S. Pat. No. 4,351,067 each of the pair of gloves has a strap that can be closed into a separate loop using a Velcro™ fastener. Also, the ends of the straps have additional fasteners to allow the gloves to be attached side-by-side. The straps also have holes 42 which allow the gloves to be suspended on a support rod prior to sale. This reference has no disclosure of how a display panel can be attached to the gloves.

Accordingly, there is a need for a merchandising system that can connect a pair of articles, such as gloves, to a display panel, without marring or defacing the articles.

SUMMARY OF THE INVENTION

In accordance with the illustrative embodiments demonstrating features and advantages of the present invention, there is provided a merchandising system for displaying merchandise on a display rack. The system has a pair of articles to be worn by a person. According to one aspect of the present invention, these articles are gloves. The articles have a right main body and a left main body, each with a user opening (for a glove, a hand opening). The pair of articles have attachment means for providing an outlying attachment locus for the articles. The attachment means includes a right extremity and a left extremity secured at the user opening of the right main body and the left main body, respectively. The right and the left extremity are each able to reach out of the user opening. The attachment means also includes a display arrangement including a panel. The attachment means is arranged to detachably secure the articles together with the panel, and the right extremity and the left extremity. The attachment means is adapted to hang on the display rack and support the articles. Thus the articles can be attached to and detached from the attachment means without marring either the right main body or the left main body of the articles.

By employing a system of the foregoing type, articles such as gloves can be easily displayed on a rack without marring or defacing the merchandise. In a preferred embodiment, rectangular tabs are sewn into the hem or binding strip of the articles. For example, these tabs can be sewn at the border of the hand openings of a pair of gloves. These tabs can then be fastened to a display panel which has a hole or hook for hanging the display panel. The display panel can be a simple card, folded card or a multiple part card.

In one embodiment, a folded display panel can straddle and attach to both tabs, with one wing of the display panel tucked into one of the gloves. In still other embodiments, the tabs can be attached on one side of display card or can be sandwiched around the display card. In any event, the hand opening of one or both of the gloves can be left open so that a prospective purchaser can try at least one of the globes on for fit.

In another embodiment, the two tabs can be attached together to form a linking strip that is looped through an aperture in a display card that can then be hung on a display rack. In still another embodiment, a display panel can have a pair of integral tabs or extremities that can be sewn into the hem or binding along the hand opening of a pair of gloves.

Instead of tabs, some embodiments will employing a cord or line that is a freely extending portion of the stitching of the article. The end of this free portion can connect to a display panel. Alternatively, this free portion can be secured at both ends to the article to form an arch that can be attached to a display panel.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 6 is an exploded, axonometric view of a portion of a merchandising system that is an alternate to that shown in the above Figures;

FIG. 7 is an exploded, axonometric view of a portion of a merchandising system that is an alternate to that shown in the above Figures;

FIG. 9 is a cross-sectional view of the joint of FIG. 3 with the joint assembled;

DETAILED DESCRIPTION OF THE PREFERRED EMBODIMENTS

Figure 1:
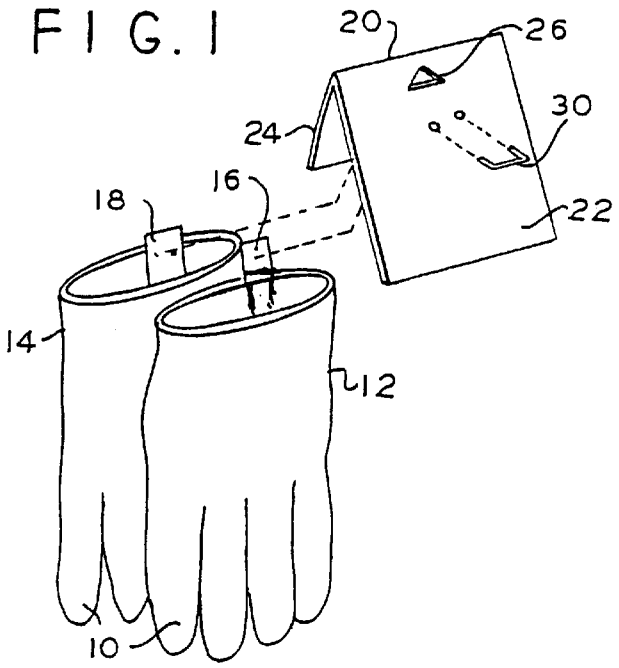
FIG. 1 is an exploded, axonometric view of a merchandising system in accordance with the principles of the present invention.
Figure 2:
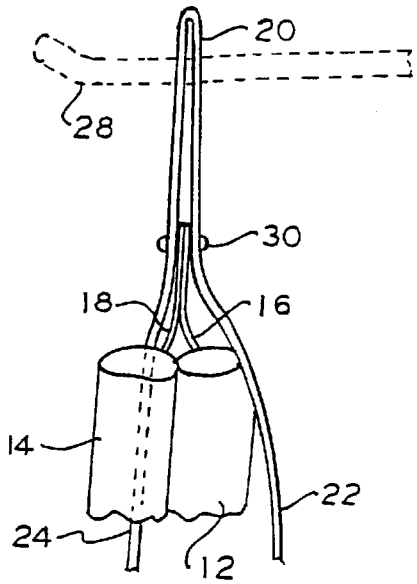
FIG. 2 is in an edge view of a portion of the system of FIG. 1 with the system assembled.
Figure 3:
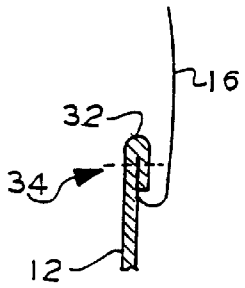
FIG. 3 is a cross-sectional view showing the joint between the tab and glove of FIG. 1.

Referring to FIGS. 1, 2, and 3, a merchandising system is shown for holding and displaying a pair of articles, namely, gloves 10. The left main body 10 and the right main body 14 have a left tab 16 and right tab 18, respectively, attached at the hand openings of the gloves 10. The left and the right tabs 16 and 18 are also referred to as left and right extremities at the user openings. Tabs 16 and 18 can be made of sheet plastic, fabric, or other sheet material. In one embodiment, the portions of tabs 16 and 18 extending from the gloves have a rectangular outline 2.8 cm long and 2.3 cm wide, although other dimensions and outlines are anticipated. Preferably, tabs 16 and 18 expand out of the hand openings of main bodies 12 and 14.

A display (or support) arrangement is shown as a folded panel 20 having a pair of wings 22 and 24. Panel 20 may be formed of cardboard, sheet plastic or other materials that may be useful for displaying information about the goods. Panel 20 may be printed with typical merchandising information such as trademarks, appropriate images or graphics, a description of the features and qualities of the goods, the source of the goods, warranty information, and the like. Each of the wings 22 and 24 have a hang hole 26 designed to fit over peg 28 of a display rack.

Panel 20 is shown attached to tabs 16 and 18 by means of a staple 30, which is driven through wing 22, tabs 16 and 18, and wing 24. Other embodiments may avoid using a staple but will connect these elements together by rivets, stitches, clamps, glue, or other fastening means. The combination of panel 20 and tabs 16 and 18 is also referred to as an attachment means. Wing 24 is shown tucked into the main body 14 of the right glove. Thus positioned, a prospective purchaser can still insert a right hand into the glove and try it on for fit.

In this embodiment, tab 16 is located on the palm side of left glove 12. The tab 18 is located on the backhand side of right glove 14. Accordingly, tabs 16 and 18 are adjacent when gloves 10 are stacked with their palms facing in the same direction. In other embodiments, the gloves can be stacked with the palms facing each other, or facing away from each other. In these latter cases, the tabs can be placed with both on the palm side, or with both on the backhand side. In any event, it is preferred to stack the gloves so that the tabs are next to each other and do not have to reach across the hand opening.

FIG. 3 shows previously mentioned tab 16 stitched into the hem 32 formed at the hand opening of left main glove body 12. Hem 32 is shown as an inward fold that is stitched along the line 34.

Figure 4:
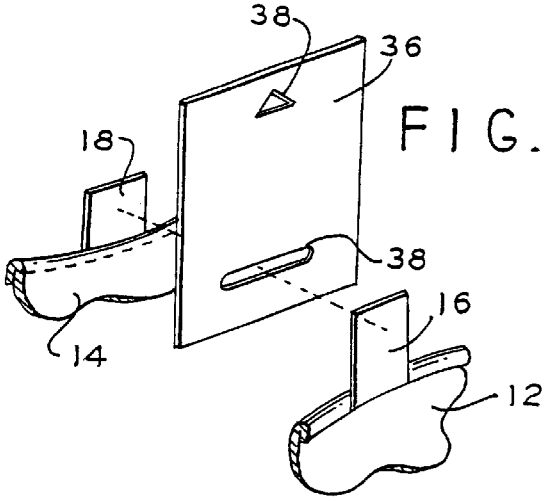
FIG. 4 is an exploded, axonometric view of a portion of a merchandising system that is an alternate to that of FIG. 1.
Figure 5:
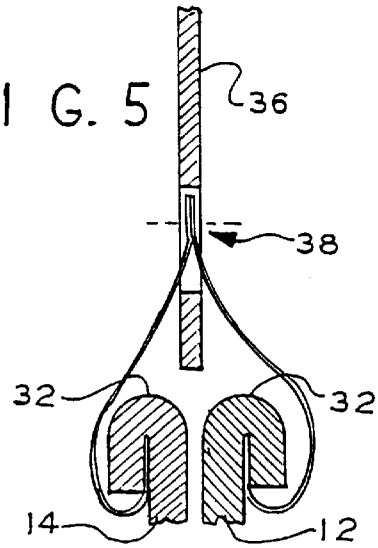
FIG. 5 is a cross-sectional view of the system of FIG. 4 with the system assembled.

Referring to FIGS. 4 and 5, previously mentioned main bodies 12 and 14 are shown with their tabs 16 and 18 routed from opposite sides of display panel 36 to meet at aperture 38 of the panel 36. Panel 36 a shown with a rectangular outline and, near its top edge, a hang hole 30. The distal ends of tabs 16 and 18 are shown connected together to form a linking strip. Tabs 16 and 18 can be secured together by stapling, gluing, heat sealing, etc. In some embodiments, tabs 16 and 18 can simply be right and left extremities of a single, unitary strip whose ends are stitched into the hems 32 of the gloves.

Referring to FIG. 6, gloves 12 and 14 are stacked with their palms facing display card 40, which has a hang hole 42. With this configuration, tab 18 will reach over the hand opening of left glove 12, restricting access to that glove. Still, the hand opening of right glove 14 will remain accessible so that a user can try this glove on for fit. Tabs 16 and 18 can be attached to display card 40 by various means, such as stapling. In some embodiments, gloves 12 and 14 will be attached to opposite sides of display card 40.

Referring to FIG. 7, the attachment means has a folded display panel 44, similar to panel 20 of FIG. 1. The attachment means of FIG. 7 also has a hanging card 46 (also referred to as a support arrangement) shown with a hooked extension 48 (although a hang hole may be used in other embodiments instead). The tabs 16 and 18 of glove bodies 12 and 14 are located on opposite sides of card 46. A staple 50 is shown about to be driven through both wings of display panel 44, and through tabs 16, card 46, and tab 18.

Accordingly, this attachment means separates the display function from the devices used to hang the arrangement on a display rack. In some cases, the card 46 may be made of a different material than panel 44. This may be advantageous where the hooked extension needs to be made of a stiffer or more durable material than is required for the display panel 44.

Figure 8:
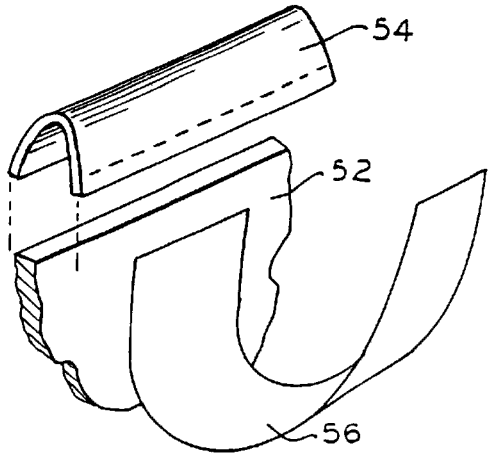
FIG. 8 is an exploded, fragmentary view of a joint between a tab and glove, that is an alternate to that of FIG. 3.

Referring to FIGS. 8 and 9, a fragment of the main body 52 of a glove is shown at the hand opening. A binding strip 54 is shown stitched (or about to be stitched) in place to straddle the edge of the main glove body 52 at its hand opening. Binding strip 54 can be made of cloth, plastic film or other materials useful for reinforcing the edge of main body 52. Also, binding strip 54 can be secured in place by glue, heat sealing, or other fastening techniques.

Tab 56 is shown positioned along the edge of the hand opening of glove body 52, in order to be trapped between glove body 52 and binding strip 54. In other embodiments, tab 56 may be fastened to the inside face of glove body 52 by separate stitches or by other fastening means, independent of binding strip 54.

Figure 11:
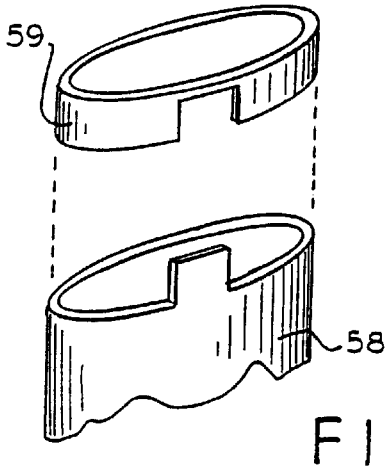
FIG. 11 is in axonometric view the showing the fabrication step associated with the joint of FIG. 10.
Figure 10:
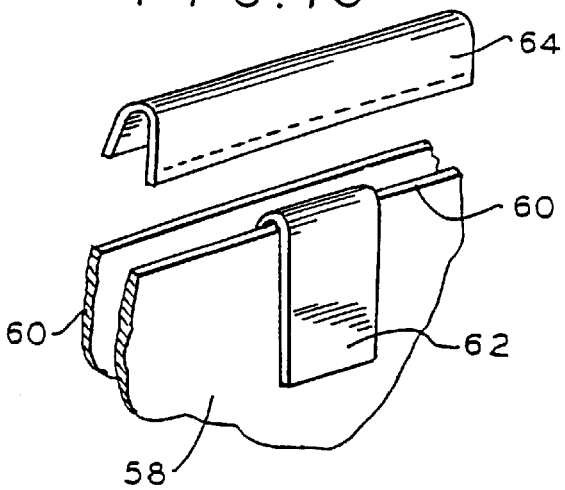
FIG. 10 is a detailed, exploded, fragmentary view of a joint between a tab and glove, that is an alternate to that shown in the above Figures.

Referring to FIG. 10, a glove body is shown composed of an inner ply 58 and an outer ply 60. Outer ply 60 may be a durable material such as leather, while inner ply 58 may be a flexible material having a more comfortable feel. In this embodiment, the outer edge of ply 58 has along the hand opening a tabbed margin 60 with a tabbed portion 62. The tabbed portion 62 can be formed as shown in FIG. 11, wherein ply 58 is illustrated as a tubular body that is trimmed to form the tabbed portions 62, thereby resulting in waste material 59. In other embodiments, ply 58 can be fabricated using knitting techniques that create the tabbed portion 62, without creating any waste. In any event, plies 58 and 60 are secured together along their outer edge by binding strip 64, which is secured to these edges by stitching, gluing, or other fastening techniques. Tabbed portion 62 is folded inwardly as illustrated to accommodate the binding strip 64.

Referring again to FIG. 11, in some embodiments the body 58 will be dipped in a synthetic material that can cure to form a flexible, waterproof layer (not shown) on the outside of body 58. In such an embodiment, the additional ply and binding strip illustrated in FIG. 10 will be eliminated.

Figure 12:
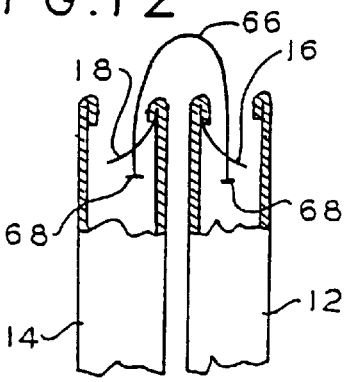
FIG. 12 is a fragmentary view, partly in section, of a portion of a merchandising system that is an alternate to that shown in the above Figures.

Referring to FIG. 12, main glove bodies 12 and 14 are shown with previously mentioned tabs 16 and 18, respectively. Tabs 16 and 18 are linked together by a plastic filament terminating in cross bars 68. Plastic filamentary fasteners of this type are known in the garment industry. These fasteners can be attached by punching cross bars 68 through the tabs 16 and 18. Thereafter cross bars 68 act like barbs and prevent filament 66 from disconnecting from tabs 16 and 18. A display panel (not shown) can be attached to filament 66. In some embodiments filament 66 may be sufficiently long and strong to allow gloves 12 and 14 to be hung on the filament 66.

Figure 13:
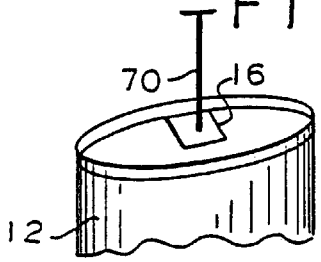
FIG. 13 is a detailed, axonometric view of an extremity that is an alternate to those previously shown in the above Figures.

Referring to FIG. 13, previously mentioned glove body 12 is shown with its tab 16 fastened to a plastic filament 70, which is similar to the filament of FIG. 12. Again, filament 70 is punched through tab 16 to provide an extension of the tab. In some embodiments, filament 70 may be directly connected to a display card (not shown).

Figure 14:
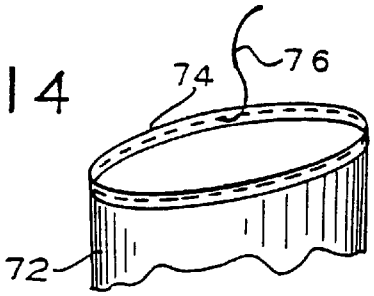
FIG. 14 is a detailed, axonometric view of an extremity that is an alternate to those previously shown in the above Figures.

Referring to FIG. 14, the illustrated glove body 72 is similar to those previously described. The edge of glove body 72 at the hand opening has a binding strip 74 similar to that shown in FIG. 8. In this embodiment, strip binding 74 is stitched in place and the threads for the stitched portion extend into a free portion, forming a tail line 76 that acts as a right or left extremity. Tail line 76 can be attached to one of the previously described display panels. Specifically, tail line 76 can be attached to a display panel so that gloves can be suspended on a display rack.

Figure 15:
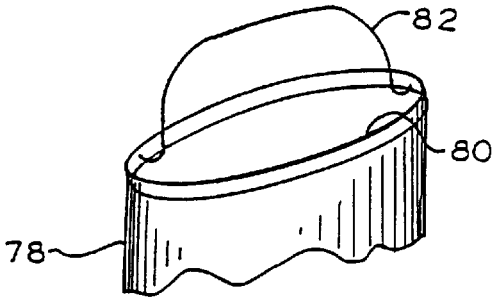
FIG. 15 is a detailed, axonometric view of an extremity that is an alternate to those previously shown in the above Figures.

Referring to FIG. 15, the illustrated glove body 78 is similar to those previously described. The edge of glove body 78 at the hand opening has a binding strip 80 similar to that shown in FIG. 8. In this embodiment, strip binding 80 is stitched in place and the threads for the stitched portion extend into a free portion, which forms a tail line 82 that acts as an extremity. Tail line 82 is secured at diametrically opposed positions along the binding strip 80 to form and arch. Tail line 82 is shown extending across the hand opening in a right to left direction.

Figure 16:
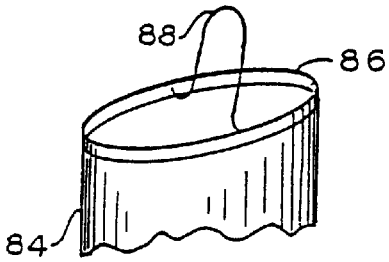
FIG. 16 is a detailed, axonometric view of an extremity that is an alternate to those previously shown in the above Figures.

Recurrent to FIG. 16, the illustrated glove body 84 is similar to those previously described. The edge of glove body 84 at the hand opening has a binding strip 86 similar to that shown in FIG. 8. In this embodiment, strip binding 86 is stitched in place and the threads for the stitched portion extend into a free portion, which forms a tail line 82 that acts as an extremity. Tail line 88 is secured at diametrically opposed positions along the binding strip 86 to form an arch. Tail line 88 is shown extending across the hand opening in a front to back direction.

Figure 17:
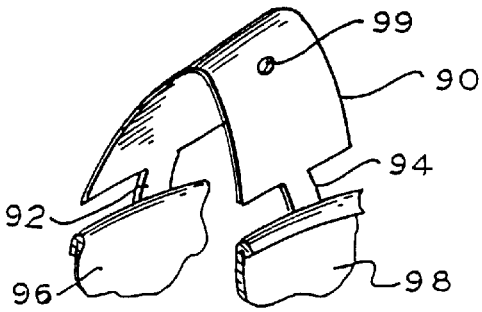
FIG. 17 is a fragmentary view, partly in section, of a portion of a merchandising system that is an alternate to that shown in the above Figures.

Referring FIG. 17, the attachment means has a folded display panel 90 with integral right and left extremities 92 and 94. Extremities 92 and 94 are fastened to the edge of the hand openings of main glove bodies 96 and 98, which are similar to the previously described glove bodies. Panel 90 has a pair of the hang holes 99 for hanging the gloves on a display rack.

In each of the foregoing embodiments, the display panel or other material used to hang the gloves from a display rack can be attached to the gloves without marring for defacing the main body of the gloves. In some cases, the main body of the gloves may be formed from a premium material such as leather. Accordingly, staples or other fastening devices can impinge on the tabs (embodiments of FIGS. 1–12) or other extremities (embodiments of FIGS. 13–17) without touching the main body of the gloves. For example, tabs 16 and 18 (FIG. 1) may be defaced, but these tabs can either be clipped off, or tucked inside the glove without degrading its appearance. Moreover, the gloves can be suspended on a display card and the tabs or other extremities can be arranged to allow free access to one or more of the gloves. Thus, a prospective purchaser can insert a hand into one of the gloves to try it for fit.

It is appreciated that various modifications may be implemented with respect to the above described, preferred embodiment. While the foregoing shows attaching gloves together in a merchandising system, in other embodiments other merchandise can be employed. For example, the merchandising system can be used for displaying socks or other goods, which have an opening to allow a user to wear the goods. Moreover the size, shape, outline, and other characteristics of the display panels can be altered depending upon the intended type of display rack, the desired message, strength of attachment, etc.

Obviously, many modifications and variations of the present invention are possible in light of the above teachings. It is therefore to be understood that within the scope of the appended claims, the invention may be practiced otherwise than as specifically described.

What is claimed is:

1. A merchandising system for displaying merchandise on a display rack, comprising a set of articles including at least a first article and a second article, each of said first and second articles having a user opening and a tab attached proximate to said user opening, each of said tabs being movable between a first position, in which it is completely inside its respective article, and a second position, in which it is extended out of its respective article through said user opening thereof, said tabs being juxtaposed to each other when they are in their said second positions; a display panel having hanging means for hanging on a display rack; and fastening means for fastening said juxtaposed tabs to each other and to said display panel.

2. The merchandising system of claim 1, wherein said display panel includes a first wing and a second wing, said first wing being inserted into said user opening of said first article and being sized and shaped so as to fit into said user opening of said first article without obstructing said user opening thereof, whereby a user desiring to try on said first article is able to do so by gaining access to said first article through said user opening thereof.

3. The merchandising system of claim 2, wherein said second wing extends over said user opening of said second article, thereby obstructing said user opening of said second article.

4. The merchandising system of claim 2, wherein said second wing is inserted into said user opening of said second article without obstructing said user opening thereof, whereby a user desiring to try on said second article is able to do so by gaining access to said second article through said user opening thereof.

5. The merchandising system of claim 2, wherein said hanging means of said display panel includes a hang hole in each of said first and second wings of said display panel, each of said hang holes being sized and shaped to fit over a peg of a display rack.

6. The merchandising system of claim 2, wherein said display panel is made of cardboard.

7. The merchandising system of claim 2, wherein said display panel is made of sheet plastic.

8. The merchandising system of claim 1, wherein each of said tabs is substantially planar and is sized and shaped to fit entirely within its respective article when in its said first position and to extend out of said user opening of its respective article when in its said second position.

9. The merchandising system of claim 8, wherein said tabs are juxtaposed with one another and sandwiched together between said first and second wings of said display panel when in their said second positions.

10. The merchandising system of claim 9, wherein said fastening means includes stitches that extend through said first wing, said juxtaposed tabs of said first and second articles and said second wing, thereby securing together said first wing, said juxtaposed tabs of said first and second articles and said second wing.

11. The merchandising system of claim 9, wherein said fastening means includes at least one rivet that passes through said first wing, said juxtaposed tabs of said first and second articles and said second wing, thereby securing together first wing, said juxtaposed tabs of said first and second articles and said second wing.

12. The merchandising system of claim 9, wherein said fastening means includes at least one staple that passes through said first wing, said juxtaposed tabs of said first and second articles and said second wing, thereby securing together first wing, said juxtaposed tabs of said first and second articles and said second wing.

13. The merchandising system of claim 9, wherein said fastening means includes glue that is applied to both sides of each of said juxtaposed tabs of said first and second articles such that said first wing, said juxtaposed tabs of said first and second articles and said second wing are glued together.

14. The merchandising system of claim 9, wherein each of said tabs is attached to its respective article in a detachable manner such that detachment will not result in damage to said articles.

15. The merchandising system of claim 9, wherein said first article is a first glove having a palm side and a back side positioned opposite said palm side of said first glove and said second article is a second glove having a palm side and a back side positioned opposite said palm side of said second glove.

16. The merchandising system of claim 15, wherein said tab of said first glove is attached to said palm side thereof and said tab of said second glove is attached to said palm side thereof, said first and second gloves being arranged such that their respective palm sides are facing one another.

17. The merchandising system of claim 15, wherein said tab of said first glove is attached to said palm side thereof and said tab of said second glove is attached to said back side thereof, said first and second gloves being arranged such that said palm side of said first glove faces said back side of said second glove.

18. The merchandising system of claim 15, wherein said tab of said first glove is attached to said back side thereof and said tab of said second glove is attached to aid back side thereof, said first and second gloves being arranged such that their respective back sides are facing one another.

19. The merchandising system of claim 15, wherein said first glove includes an inwardly turned hem that is proximate to and circumscribes said user opening thereof and said second glove includes an inwardly turned hem that is proximate to and circumscribes said user opening thereof, said tab of said first glove being attached to said first glove at said hem thereof and said tab of said second glove being attached to said second glove at said hem thereof.

20. The merchandising system of claim 8, wherein said tabs are made of sheet material

21. The merchandising system of claim 20, wherein said sheet material is sheet plastic.

22. The merchandising system of claim 20, wherein said sheet material is fabric.

23. The merchandising system of claim 1, wherein said display panel includes indicia for conveying merchandising information to potential users.

* * * * *